United States Patent [19]

Leifeld

[11] Patent Number: 4,928,355

[45] Date of Patent: May 29, 1990

[54] LAP EVENER FOR A FIBER PROCESSING MACHINE

[75] Inventor: Ferdinand Leifeld, Kempen, Fed. Rep. of Germany

[73] Assignee: Trützschler GmbH & Co. KG, Monchengladbach, Fed. Rep. of Germany

[21] Appl. No.: 261,518

[22] Filed: Oct. 3, 1988

[30] Foreign Application Priority Data

Oct. 5, 1987 [DE] Fed. Rep. of Germany ..... 3733631

[51] Int. Cl.[5] ..... D01G 15/40

[52] U.S. Cl. ..... 19/105

[58] Field of Search ..... 19/105, 157, 160, 161, 19/163

[56] References Cited

U.S. PATENT DOCUMENTS

| | | | |
|---|---|---|---|
| 3,709,406 | 1/1973 | Binder et al. | 19/105 |
| 4,030,635 | 6/1977 | Hablützel et al. | 19/105 |
| 4,240,180 | 12/1980 | Wood et al. | 19/105 |
| 4,506,413 | 3/1985 | Leifeld | 19/105 |

FOREIGN PATENT DOCUMENTS

| | | | |
|---|---|---|---|
| 2912576 | 7/1982 | Fed. Rep. of Germany . | |
| 8525938 | 3/1987 | Fed. Rep. of Germany . | |
| 2826101 | 4/1987 | Fed. Rep. of Germany . | |
| 3535684 | 4/1987 | Fed. Rep. of Germany . | |
| 3608514 | 9/1987 | Fed. Rep. of Germany | 19/105 |
| 2001366 | 1/1979 | United Kingdom . | |
| 2014206 | 8/1979 | United Kingdom . | |

*Primary Examiner*—Werner H. Schroeder
*Assistant Examiner*—D. Price
*Attorney, Agent, or Firm*—Spencer & Frank

[57] ABSTRACT

A textile fiber processing assembly includes a feed chute having a bottom portion provided with a fiber outlet through which fiber material is discharged; a fiber feeding arrangement positioned externally of the feed chute downstream of the outlet opening and including a feed roller and a counterelement. Either the feed roller or the counterelement is stationarily supported, while the other component is movably supported to allow excursions thereof towards and away from the respective other stationary component as a function of the thickness of fiber material passing through the fiber feeding arrangement. There are further provided a drive motor for rotating the feed roller; and a textile fiber processing machine having an input and a fiber processing roller situated at the input downstream of the fiber feeding arrangement. The feed roller adjoins the outlet and is arranged for drawing fiber material from the feed chute through the outlet and advancing the fiber material to the fiber processing roller. There is also provided a measuring member connected to the movably supported feed roller or counterelement and arranged for generating signals representing the excursions. The rpm of the feed roller is controlled as a function of the signals.

11 Claims, 4 Drawing Sheets

1
2
3
4
5
6
7
8
9
10
11
12
13
14
14a
14b
15
16
17
18

LAP EVENER FOR A FIBER PROCESSING MACHINE

CROSS REFERENCE TO RELATED APPLICATION

U.S. patent application Ser. No. 07/261,519, filed October 3, 1988 and entitled Apparatus For Feeding A Fiber Lap To A Fiber Processing Machine and being the counterpart of Federal Republic of Germany Application No. P 37 33 632.0 discloses related subject matter and is incorporated herein by reference.

BACKGROUND OF THE INVENTION

This invention relates to an apparatus which is associated with a card, a roller card unit, a cleaner or a similar textile fiber processing machine and which serves for evening the fiber lap fed to the fiber processing machine. Upstream of the fiber processing machine, a fiber tuft feeding device such as a feed chute is arranged which discharges a fiber lap, subsequently advanced by a feed roller to a fiber processing roller (such as a licker-in for a card or an opening roller for a cleaner). A counterelement, such as a feed table or a counterroller cooperates with the feed roller to advance the fiber lap therebetween. Either the feed roller or the counterelement is supported stationarily, while in each instance the respective other component executes excursions to thus vary the gap between the feed roller and the counterelement.

It is known to provide for the fiber lap a transfer element such as a transfer tray between the discharge end of the feed chute and the feed roller. The fiber lap discharged downwardly from the feed chute is deflected by the transfer element from a vertical direction to an approximately horizontal orientation. This change in direction alters the inner structure of the fiber lap. Further, deflecting, guiding and compressing elements are also present which adversely affect the uniformity of the fiber lap.

SUMMARY OF THE INVENTION

It is an object of the invention to provide a fiber lap evener of the above-outlined type from which the discussed disadvantages are eliminated and which, in particular, provides for a greater uniformity of the fiber lap.

This object and others to become apparent as the specification progresses, are accomplished by the invention, according to which, briefly stated, the discharge end of the feed chute terminates immediately adjacent the feed roller so that the feed roller draws the fiber material from the feed chute, and a device is provided which generates a signal that represents the width of the gap which is defined between the feed roller and the counterelement and which varies by virtue of the excursions of either the feed roller or the counterelement in response to the quantity fluctuations of the fiber lap passing therebetween. The signal is applied to a control device which is connected to the drive motor of the feed roller to thus regulate the feed roller speed as a function of the fiber lap quantities passing through the gap.

Thus, according to the invention, components such as an intermediate element, a transfer tray, a support roller or the like which are conventionally arranged between the discharge end of the feed chute and the feed roller are dispensed with. The drawings and transporting function of the feed roller/counterelement assembly is assisted by gravity acting on the fiber lap, as well as by the fiber tuft densifying (compressing) device situated in the lower, or feed chute of a two-chute card feeder. By virtue of the fact that the conventional deflecting, guiding and compressing elements are omitted according to the invention, the usual multiple shifts the fiber lap which cause structural changes and irregularities in the fiber lap, can no longer occur.

It is known, for example, that the extent of draft between the delivery rollers at the bottom of the feed chute and the feed roller associated with the card has a significant effect on the uniformity of the sliver produced by the card: thus, unfavorable drafts may cause significant errors. The invention eliminates the sources of such errors. Even in case of a favorable draft, reorientations occur which are eliminated by the invention. The fiber lap is admitted in a more state (considered both over a time period and along the width of material at any given time) to the opening roller of the fiber processing machine, such as the licker-in of a card. A uniform advance of the fiber lap throughout its width is ensured by the fact that the transporting device, that is, the feed roller, is situated in the immediate vicinity of the opening roller (licker-in). This arrangement results in better Uster values and CV values.

By associating the movable component of the feed roller/counterelement assembly with a measuring member to sense the excursion of the movable member as a function of the throughgoing fiber material and using the sensor signal to increase or decrease the rpm of the feed roller dependent upon the thickness variations, there is achieved a short-period regulation. The direct feed, achieved by arranging the feed chute terminus immediately at the feed roller and the short-period regulation cooperate with one another for improving the uniformity of the fiber lap. Only a very narrow space is needed to accomplish these measures; this circumstance advantageously results in a compact and structurally simple apparatus.

Preferably, the discharge end of the feed chute terminates at a location which is generally above the center of the opening roller (licker-in) of the fiber processing machine.

According to further advantageous features of the invention, the movable counterelement is spring-biased, for example, by a spring weight. According to another advantageous feature of the invention, the counterelement is an independient sensor element. Preferably, the measuring member is an inductive path measuring device. According to a further advantageous feature of the invention, the measuring element is connected to the drive motor of the feed roller with the intermediary of the control device.

DESCRIPTION OF THE PREFERRED EMBODIMENTS

Figure 1:
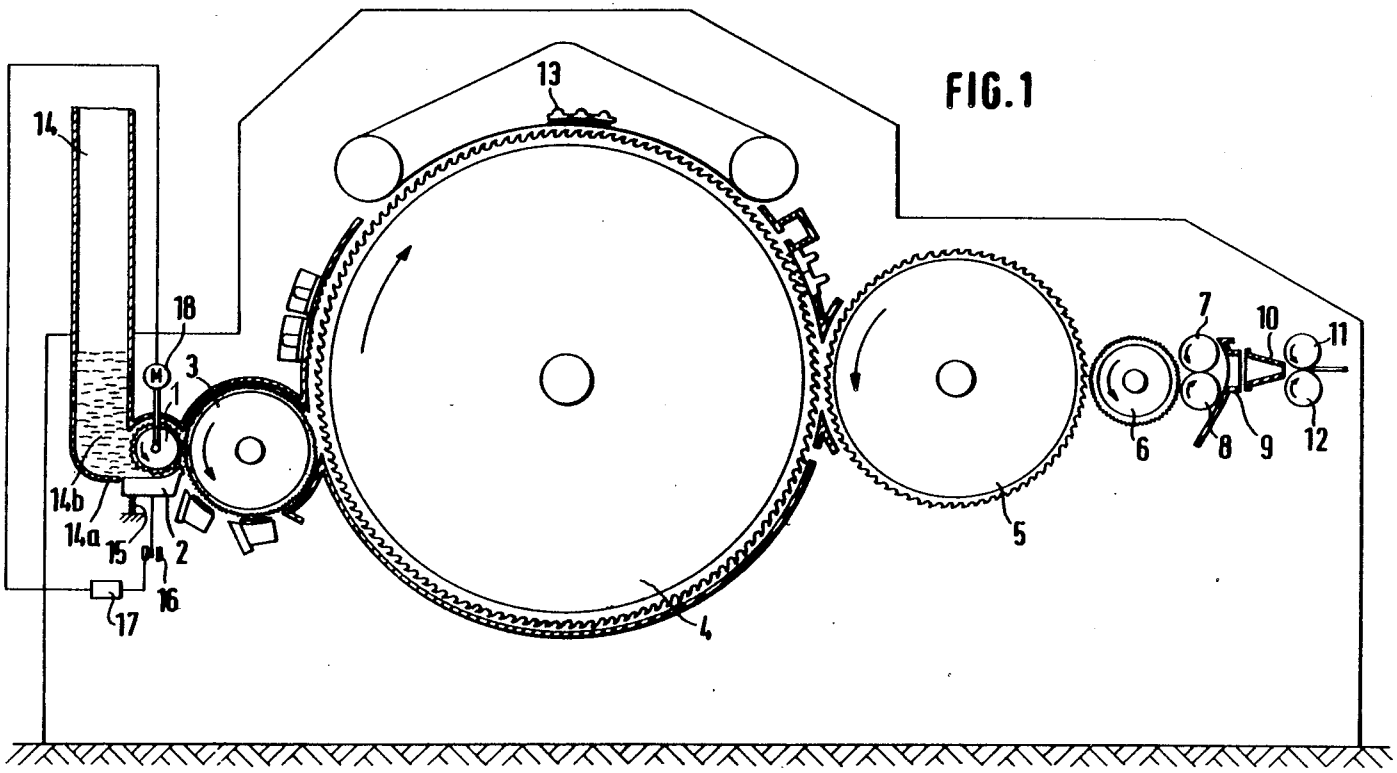
FIG. 1 is a schematic side elevational view of a carding machine and an associated, upstream-arranged feed chute, incorporating a preferred embodiment of the invention.

Turning to FIG. 1, there is illustrated therein a carding machine, which may be, for example, an EXACTA-CARD DK 715, manufactured by Trützschler G,bH and CO. KG. Mönchengladbach, Federal Republic of Germany. The carding machine has a feed roller 1, a feed table 2 cooperating therewith, a licker-in 3, a main carding cylinder 4, a doffer 5, stripping rollers 6, crushing rollers 7 and 8, a fiber web guiding element 9, a sliver trumpet 10, calender rollers 11 and 12 as well as travelling flats 13 cooperating with the carding cylinder 4.

The feed roller 1 is radially immovably supported and cooperates with the movably supported feed table 2 which is urged towards the feed roller 1 by means of a spring 15. A generally vertically oriented fiber tuft feed chute 14 has, at its bottom, a curve terminus 14*a* which ends immediately at the feed roller 1. As a result, as the feed roller 1 rotates, it draws the fiber material 14*b* directly from the feed chute 14.

The movable feed table 2 is connected with a measuring member 16 formed as an inductive path indicator for generating a signal whose magnitute represents the extent of excursion of the feed table 2 from the feed roller 1. Such excursion occurs in response to a variation in the quantities of fiber material passing between the feed roller 1 and the feed table 2. The signals generated by the device 16 and corresponding to the actual thickness value of the fiber lap passing through the roller 1 are applied to a control device 17 which in turn applies signals to a drive motor 18 for rotating the feed roller 1.

Figure 2:
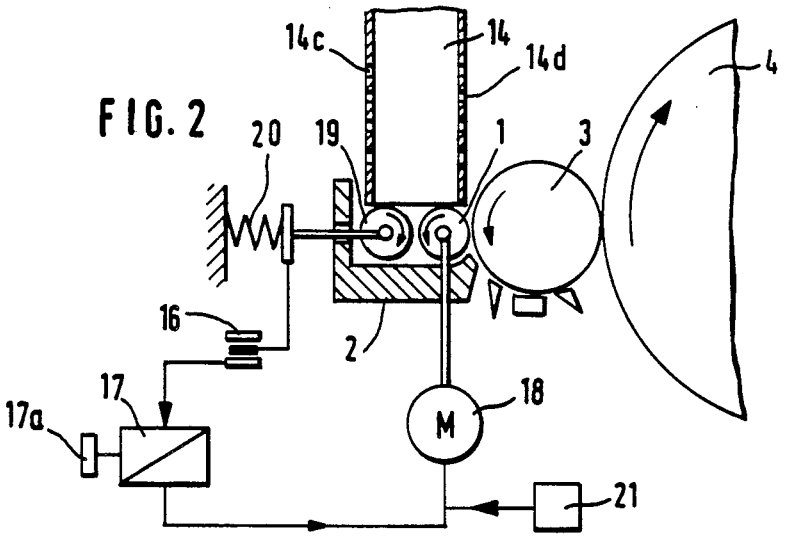
FIGS. 2-6 are each diagrammatic side elevational views of five further preferred emdodiments of the invention.

Turning now to FIG. 2, in the embodiment shown therein, the feed chute 14 is provided, in its lower zone, with air outlet apertures 14*c* and 14*d*. The feed roller 1 and a counterroller 19 arranged side-by-side at the discharge end of the feed chute 14. The counterroller 19 is urged against the feed roller 1 in a generally horizontal direction by means of a spring 20. The feed roller 1 cooperates with the counterroller 19 to draw the fiber material from the feed chute 14 and cooperates with the stationary feed table 2 to feed the fiber lap to the licker-in 3. The inductive path sensor 16 emits electric signals as a function of the actual value of the thickness of the fiber lap which passes through the gap defined between the rollers 1 and 19 and the signals are applied to the control device 17 with which there is associated a desired value setter 17*a* for the desired thickness of the fiber lap. The correcting signals for the rpm's are applied to the drive motor 18 which is coupled with a device 21 for inputting the basic rpm values for the motor.

Figure 3:
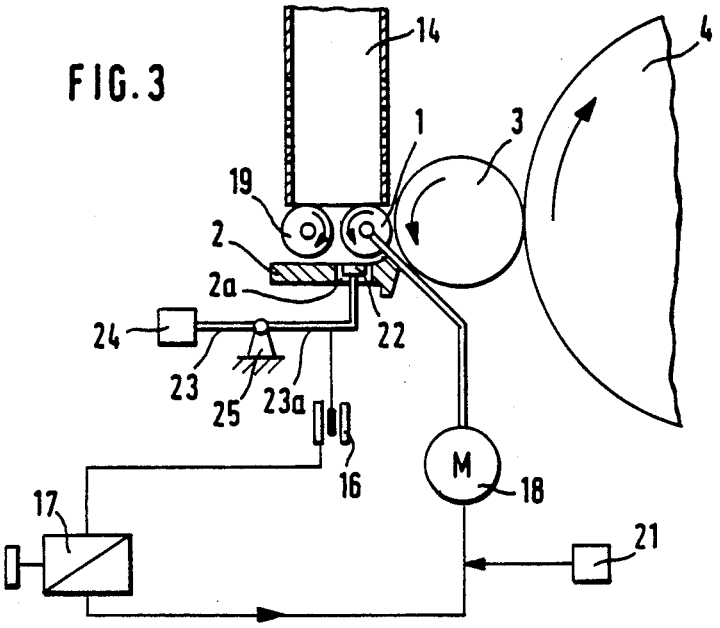

Turning now to the embodiment illustrated in FIG. 3, the feed table 2 is provided with an opening 2*a* in which at least one sensor element 22 is accommodated. The sensor element 22 is mounted at one end of a two-arm lever 23 which is rotatably mounted on a support 25 and whose other arm carries a weight 24, by means of which the sensor element 22 is resiliently urged towards the feed roller 1. The inductive path sensor 16 is connected to the lever arm 23*a*.

Figure 4:
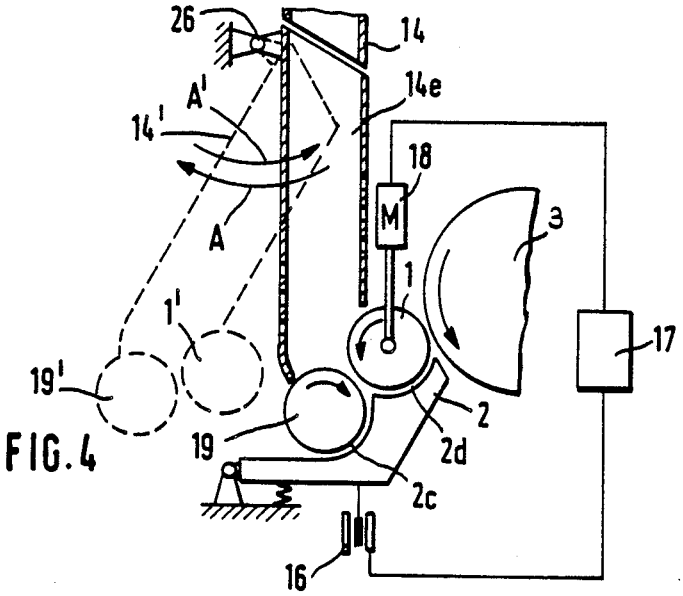

In the embodiment illustrated in FIG. 4, the feed roller 1 is situated laterally above the counterroller 19, as opposed to the side-by-side arrangement of these components in the two embodiments illustrated in FIGS. 2 and 3. In the FIG. 4 embodiment, the feed table 2 has two adjoining concave recesses 2*c* and 2*d* which conform to the convex course of the counterroller 19 and the feed roller 1, respectively. A lower terminal length portion of the feed chute 14 is supported for pivotal motion about a horizontal axis at a bearing support 26 whereby the lower feed chute portion 14*e*, together with the feed roller 1 and the counterroller 19 can be pivoted away from the feed table 2 into the dash-dotted position indicated at 14', 1' and 19' in the direction of the arrow A and may be pivoted back into the full line position in the direction of the arrow A'.

Figure 5:
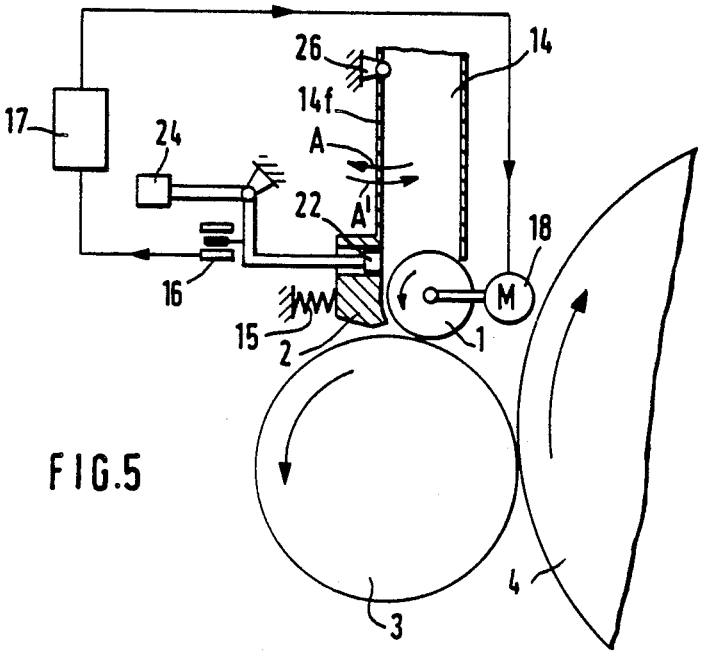

In the embodiment illustrated in FIG. 5, the feed chute 14 is situated substantially vertically above the licker-in 3. The lower portion of the chute wall 14*f* is pivotally supported at 26 for movement about the horizontal axis and is biased by a spring 15. The lower end of the feed chute wall 14*f* is designed as the feed table 2 which cooperates with the feed roller 1. The gap between the feed roller 1 and the feed table 2 extends approximately vertically above the center of the licker-in 3. The short-period regulation in the FIG. 5 embodiment corresponds to that described in connection with FIG. 3.

Figure 6:
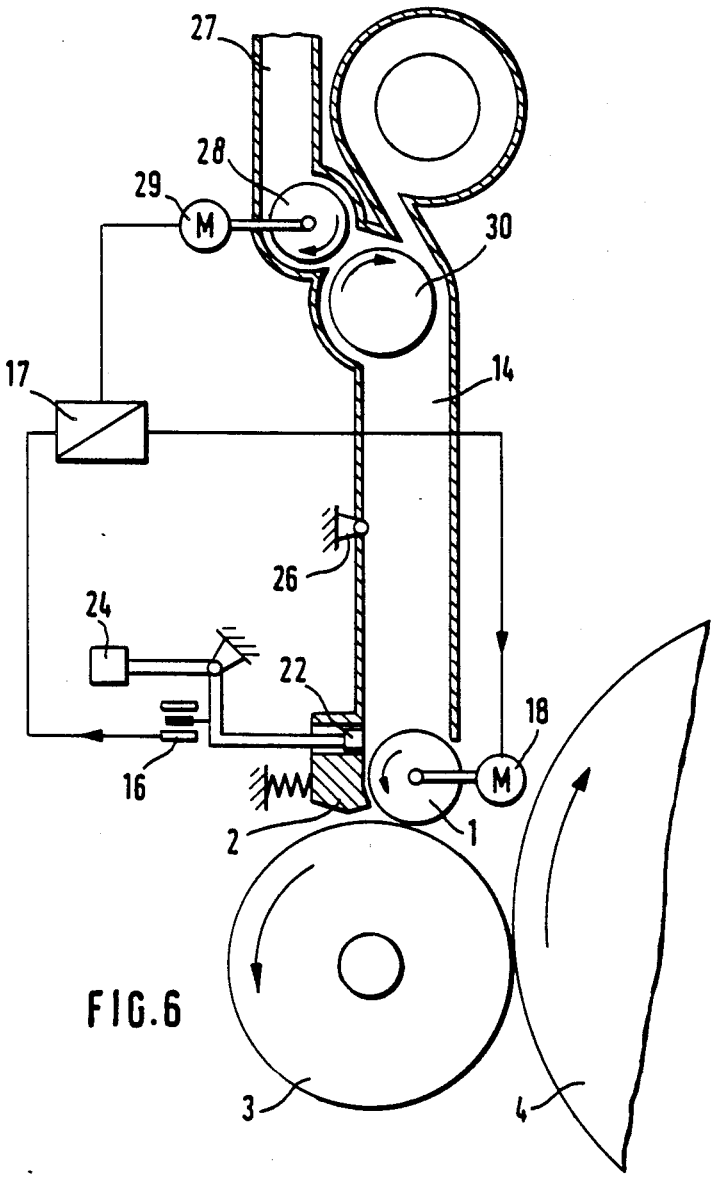

Turning now to the embodiment shown in FIG. 6, there is illustrated therein a dual-chute tuft feeder comprising a lower feed chute 14 and an upper, reverse chute 27 between which there are arranged a slowly rotating supply roller 28 and a rapidly rotating opening roller 30. The control device 17 is electrically connected with the drive motor 18 of the feed roller 1 and with the drive motor 29 of the supply roller 28. Thus, in this arrangement a single measuring member 16 serves two setting members, namely the feed roller 1 cooperating with the licker-in 3 and the supply roller 28 cooperating with the opening roller 30.

Arrows drawn into rollers 1, 3–8, 11–12, 19, 28 and 30 indicate directions of rotation.

By virtue of the fact that the terminus of the feed chute is situated above the height level of the rotary axis of the licker-in 3 as illustrated in FIGS. 3, 5 and 6, it is feasible to provide, for a given diameter, a greater number of knives and stationary carding devices along the circumferential surface of the licker-in. In case the diameter of the licker-in is reduced, a higher rpm is possible at the same circumferential speed. In this manner, a larger centrifugal force is generated which inproves the separation of trash and other impurities.

The present disclosure relates to subject matter container in Federal Republic of Germany Patent Application No. P 37 33 631.2 (filed October 5th, 1987) which is incorporated herein by reference.

It will understood that the above description of the present invention is susceptible to various modifications, changes and adaptations, and the same are intended to be comprehended within the meaning and range of equivalents of the appended claims.

What is claimed is:

1. In a textile fiber processing assembly including a feed chute adapted to be charged with fiber material and having a bottom portion provided with an outlet opening through which the fiber material is discharged;

a fiber feeding arrangement positioned externally of the feed chute downstream of the outlet opening as viewed in a direction of advance of the fiber material upon discharge thereof from said outlet opening; said fiber feeding arrangement including two cooperating components; one of said components being a feed roller and the other of said components being a counterelement; one of said components being stationarily supported and the other of said components being movably supported to allow excursions thereof towards and away from the respective other component as a function of the thickness of fiber material passing through the fiber feeding arrangement;

a drive motor connected to said feed roller for rotating said feed roller; and a carding machine having an input and licker-in situated at said input downstream of said fiber feeding arrangement and arranged for receiving the fiber material advanced by said fiber feeding arrangement;

the improvement wherein said feed roller adjoins said outlet opening for drawing fiber material from the feed chute through said outlet opening; further wherein said feed roller immediately adjoins said licker-in for advancing the fiber material directly to said licker-in;

the improvement further comprising a measuring member connected to the movably supported component and arranged for generating signals representing said excursions; and control means for connecting said measuring member to said drive motor for controlling the rotation of said feed roller as a function of said signals.

2. A textile fiber processing assembly as defined in claim 1, wherein the stationarily supported component is said counterelement and the movably supported component is said feed roller.

3. A textile fiber processing assembly as defined in claim 1, wherein said measuring member comprises an inductive path determining device.

4. A textile fiber processing assembly as defined in claim 1, wherein said outlet opening is situated at a height level above a rotary axis of said feed roller.

5. A textile fiber processing assembly as defined in claim 1, said drive motor being a first drive motor; wherein said feed chute is generally of vertical orientation; further comprising a reverse chute situated above the feed chute and being coupled thereto; a supply roller supported for rotation between said reserve chute and said feed chute for drawing fiber material from said reserve chute; a second drive motor connected to said supply roller for rotating said supply roller; said control means being connected to said second drive motor.

6. A textile fiber processing assembly as defined in claim 1, wherein the stationarily supported component is said feed roller and the movably supported component is said counterelement.

7. A textile fiber processing assembly as defined in claim 6, further comprising a force-exerting means for urging said counterelement against said feed roller.

8. A textile fiber processing assembly as defined in claim 7, wherein said force-exerting means is a spring.

9. A textile fiber processing assembly as defined in claim 7, wherein said force-exerting means is a weight.

10. A textile fiber processing assembly as defined in claim 7, further comprising a feed table cooperating with said feed roller for advancing the fiber material; said counterelement being situated at said feed table and being arranged to be movable independently therefrom.

11. In a textile fiber processing assembly including a generally vertically oriented feed chute adapted to be charged with fiber material and having a bottom portion provided with an outlet opening through which the fiber material is discharged;

a fiber feeding arrangement positioned externally of the feed chute downstream of the outlet opening as viewed in a direction of advance of the fiber material upon discharge thereof from said outlet opening; said fiber feeding arrangement including two cooperating components; one of said components being a feed roller and the other of said components being a counterelement; one of said components being stationarily supported and the other of said components being movably supported to allow excursions thereof towards and away from the respective other component as a function of the thickness of fiber material passing through the fiber feeding arrangement;

a first drive motor connected to said feed roller for rotating said feed roller;

a reserve chute situated above the feed chute and being coupled thereto;

a supply roller supported for rotation between said reserve chute and said feed chute for drawing fiber material from said reserve chute;

a second drive motor connected to said supply roller for rotating said supply roller; and a textile fiber processing machine having an input and a fiber processing roller situated at said input downstream of said fiber feeding arrangement and arranged for receiving the fiber material advanced by said fiber feeding arrangement;

the improvement wherein said feed roller adjoins said outlet opening and is arranged for drawing fiber material from the feed chute through said outlet and advancing the fiber material to said fiber processing roller;

the improvement further comprising a measuring member connected to the movably supported component and arranged for generating signals representing said excursions; and control means for connecting said measuring member to said first and second drive motors for controlling the rotation of said feed roller and said supply roller as a function of said signals.

* * * * *